US009650792B2

(12) United States Patent
Ramachandra

(10) Patent No.: US 9,650,792 B2
(45) Date of Patent: May 16, 2017

(54) INTERLOCKING FLOOR PANELS AND FLOOR SYSTEM

(71) Applicant: ARMSTRONG WORLD INDUSTRIES, INC., Lancaster, PA (US)

(72) Inventor: Sunil Ramachandra, Lancaster, PA (US)

(73) Assignee: AFI Licensing LLC, Lancaster, PA (US)

( * ) Notice: Subject to any disclaimer, the term of this patent is extended or adjusted under 35 U.S.C. 154(b) by 0 days.

(21) Appl. No.: 14/580,312

(22) Filed: Dec. 23, 2014

(65) Prior Publication Data

US 2016/0177576 A1 Jun. 23, 2016

(51) Int. Cl.
*E04F 15/02* (2006.01)
*E04F 15/04* (2006.01)

(52) U.S. Cl.
CPC ..... *E04F 15/02016* (2013.01); *E04F 15/02* (2013.01); *E04F 15/02022* (2013.01); *E04F 15/04* (2013.01); *E04F 15/02033* (2013.01); *E04F 15/02038* (2013.01); *E04F 2201/0138* (2013.01); *E04F 2201/0153* (2013.01); *E04F 2201/03* (2013.01); *E04F 2201/049* (2013.01);
(Continued)

(58) Field of Classification Search
CPC ..... E04F 2201/0535; E04F 2201/0146; E04F 2201/0564; E04F 2201/096; E04F 2201/091; E04F 15/02016; E04F 15/04; E04F 15/02022; E04F 15/02038; E04C 2/38; E04C 2/30
USPC .. 52/591.3, 592.1, 591.1, 589.1, 588.1, 578, 52/581, 390–392
See application file for complete search history.

(56) References Cited

U.S. PATENT DOCUMENTS 5,103,614 A 4/1992 Kawaguchi et al.
5,295,341 A * 3/1994 Kajiwara ..... E04B 1/6129 404/41

(Continued)

FOREIGN PATENT DOCUMENTS

| | | |
|---|---|---|
| CN | 201507095 | 6/2010 |
| EP | 2063044 | 5/2009 |
| WO | 03012224 | 2/2003 |

OTHER PUBLICATIONS

AU Search Report for corresponding AU Application No. 2015227440, mailed Feb. 25, 2016.

*Primary Examiner* — Joshua J Michener
*Assistant Examiner* — Matthew Gitlin

(57) ABSTRACT

A floating floor system includes a plurality of interlocking floor panels, each including a base layer formed from a first material having a first hardness; a body formed from the base layer and having a top surface and a bottom surface; a first locking edge portion formed from the base layer and including a locking channel defined by a channel floor and first and second channel sidewalls extending upward from the channel floor toward the top surface; a second locking edge portion formed from the base layer and including a locking ridge protruding downward away from an upper surface of the second locking edge portion and defined by a ridge surface and first and second ridge sidewalls; wherein at least one of the sidewalls includes a portion formed from a second material having a second hardness that is less than the first hardness.

17 Claims, 11 Drawing Sheets

(52) U.S. Cl.
CPC ... *E04F 2201/091* (2013.01); *E04F 2201/096* (2013.01)

(56) References Cited

U.S. PATENT DOCUMENTS 5,348,778 A * 9/1994 Knipp ..... B32B 3/06 312/400
6,505,452 B1 1/2003 Hannig et al.
6,681,820 B2 * 1/2004 Olofsson ..... B23D 37/04 144/134.1
6,854,235 B2 2/2005 Martensson
7,188,456 B2 * 3/2007 Knauseder ..... E04F 13/0878 403/268
7,251,916 B2 * 8/2007 Konzelmann ..... E04F 15/04 52/591.1
7,441,384 B2 10/2008 Miller et al.
7,644,553 B2 * 1/2010 Knauseder ..... C09J 5/00 156/304.5
8,234,829 B2 8/2012 Thiers
8,341,916 B2 * 1/2013 Sjoberg ..... E04F 15/02 52/592.1
8,484,920 B2 7/2013 Thiers et al.
8,516,767 B2 * 8/2013 Engstrom ..... E04F 15/02 52/586.1
8,720,151 B2 5/2014 Pervan
8,733,065 B2 * 5/2014 Pervan ..... E04F 15/02 428/50
8,950,148 B2 * 2/2015 De Boe ..... E04F 15/02 52/309.15
9,003,735 B2 * 4/2015 Vermeulen ..... E04F 15/02038 52/582.1
9,422,727 B2 * 8/2016 Sjoberg ..... E04F 15/02
2003/0024199 A1 * 2/2003 Pervan ..... E04F 15/04 52/589.1
2004/0031227 A1 * 2/2004 Knauseder ..... E04F 13/0878 52/592.1
2004/0182036 A1 * 9/2004 Sjoberg ..... E04F 15/02 52/592.1
2009/0308001 A1 * 12/2009 Wu ..... E04B 1/762 52/173.3
2010/0043333 A1 * 2/2010 Hannig ..... E04F 15/02 52/582.2
2010/0281810 A1 * 11/2010 Ruland ..... E04F 15/02 52/588.1
2010/0300030 A1 * 12/2010 Pervan ..... B32B 21/02 52/588.1
2010/0319291 A1 * 12/2010 Pervan ..... E04F 15/02 52/588.1
2012/0034024 A1 * 2/2012 Sjoberg ..... E04F 15/02 403/267
2012/0055112 A1 * 3/2012 Engstrom ..... E04F 15/02144 52/582.2
2012/0174520 A1 * 7/2012 Pervan ..... E04F 15/02 52/588.1
2012/0174521 A1 * 7/2012 Schulte ..... F16B 5/0076 52/588.1
2013/0025231 A1 * 1/2013 Vermeulen ..... E04F 15/02038 52/588.1
2013/0104478 A1 * 5/2013 Meersseman ..... E04F 15/02 52/309.1
2013/0199120 A1 8/2013 Bergelin et al.
2013/0212971 A1 8/2013 Cordeiro
2014/0109507 A1 * 4/2014 Dossche ..... B32B 21/04 52/588.1

* cited by examiner

INTERLOCKING FLOOR PANELS AND FLOOR SYSTEM

FIELD

The present disclosure relates to flooring systems in which the floor panels comprise mechanical interlocking features having a portion thereof formed of a material having a hardness that is less than the hardness of the base layer of the floor panels.

BACKGROUND

Interlocking flooring of various types is well known. Such flooring is often referred to as "floating" because none of the flooring panels, whether they are elongated rectangular boards or less elongated panels, are secured to the subfloor.

Perhaps the most well-known type of locking flooring is tongue-in-groove floor boards, in which the tongue-in-groove feature provides locking against vertical movement along the two long edges of elongated floor boards—tongue-in-groove flooring did not originally have any locking features along the two short edges of the floor boards. As is recognized in the art, the locking features may be used with many different types of materials, such as floor panels which have a rigid high density fiberboard (HDF) base layer, with such HDF base layer panels having either a hard surface coating or a resilient plasticized vinyl surface coating, or floor panels which have a resilient base layer with a resilient plasticized vinyl surface. However, not all locking features work well with all types of flooring materials.

Over time, the long edges of floor panels have gained both horizontal and vertical locking features, as have the short edges. U.S. Pat. No. 8,293,058 describes one type of interlocking floor panels that has both long and short interlocking edges. As is described therein, interlocking along the long edge is achieved by "fold-to-lock" engagement, while interlocking along the short edge is achieved by "push-to-lock" engagement, and for the "push-to-lock" engagement, only horizontal locking is achieved. In order to achieve both horizontal and vertical locking along the short edges of panels, using "push-to-lock" engagement, more is needed. U.S. Pat. No. 6,505,452 discloses a flooring panel having long edges with "fold-to-lock" engagement and short edges with "push-to-lock" engagement, with each of the long and short edges having both horizontal and vertical locking.

For floor panels which have a less resilient base layer, or even a rigid base layer, achieving locking on the short interlocking edges often presents two problems. The first issue has to do with achieving the locking engagement between two adjacent panels along the short edge. For panels made from materials with a higher hardness, the short edge locking profiles need to include appropriate tolerances so that the locking profiles can engage and lock with each other. The tolerances make it possible to mate two short edges together in locking engagement. At the same time, tools such as a mallet may be needed in order to force the short edges into locking engagement. It is desirable to have floor panels that are easier to put into place as an assembled floor.

The other issue with floor panels that have a less resilient or rigid base layer concerns noise which develops from movement within the locking joints as the flooring ages. In flooring assembled from panels with less resilient base layer material, the rigid materials in the locking joints may begin to rub together over time. Because the material is rigid, the rubbing may produce moans and creaks when the floor is walked upon. Such rubs and creaks are generally undesirable.

For these reasons, an improved design for floor panels having a less resilient, or rigid, base layer material is desired. Embodiments of the present invention are designed to meeting these needs.

SUMMARY

In some embodiments, the present invention is directed to interlocking floor panels and a system of interlocking floor panels. In some embodiments, the interlocking floor panels have a base layer that is formed from a first material having a first hardness, and edges of the floor panels may include a second material formed from a second material having a second hardness which is lower than that first hardness.

In a first separate aspect of the present invention, a floating floor system includes a plurality of floor panels, each of the plurality of floor panels including: a base layer formed of a first material having a first hardness; a main body including a top surface and a bottom surface, the main body formed from the base layer; a first locking edge portion formed from the base layer and extending from a first side of the main body, the first locking edge portion including a locking channel defined by a channel floor, a first channel sidewall extending upward from the channel floor toward the top surface, and a second channel sidewall extending upward from the channel floor toward the top surface; a second locking edge portion formed from the base layer and extending from a second side of the main body opposite the first side, the second locking edge portion including a locking ridge protruding downward away from an upper surface of the second locking edge portion, the ridge defined by a first ridge sidewall, a second ridge sidewall, and a ridge top surface; wherein at least one of the first channel sidewall, the second channel sidewall, the first ridge sidewall, and the second ridge sidewall comprises a portion formed of a second material having a second hardness that is less than the first hardness; and wherein the plurality of floor panels are arranged in a mechanically interlocked arrangement in which the locking ridges of the plurality of floor panels have been pressed into and nest within the locking channels of adjacent ones of the plurality of floor panels such that the portions formed of the second material are compressed, thereby achieving an interference fit between the first and second channel sidewalls and the first and second ridge sidewalls.

In a second separate aspect of the present invention, a floating floor system includes a plurality of floor panels, each of the plurality of floor panels including: a base layer formed of a first material having a first hardness; a main body including a top surface and a bottom surface, the main body formed from the base layer; a first locking edge portion formed from the base layer and extending from a first side of the main body, the first locking edge portion having a first locking profile including a locking channel defined by a channel floor, a first channel sidewall extending upward from the channel floor toward the top surface, and a second channel sidewall extending upward from the channel floor toward the top surface, the channel including an upper channel section defined by upper portions of the first and second channel sidewalls and a lower channel section defined by lower portions of the first and second channel sidewalls; a second locking edge portion formed from the base layer and extending from a second side of the main body opposite the first side, the second locking edge portion having a second locking profile including a locking ridge protruding downward away from an upper surface of the second locking edge portion, the locking ridge defined by a first ridge sidewall, a second ridge sidewall, and a ridge top surface, the ridge including a base section defined by upper portions of the first and second ridge sidewalls and a distal section defined by lower portions of the first and second ridge sidewalls; wherein at least one of the upper portion of the first channel sidewall, the upper portion of the second channel sidewall, the lower portion of the first ridge sidewall, and the lower portion of the second ridge sidewall is formed of a second material having a second hardness that is less than the first hardness; and wherein the first and second locking profiles are configured so that upon the locking ridge of a first one of the plurality of floor panels being inserted into the locking channel of a second one of the plurality floor panels, the second material is compressed from a normal state to a compressed state as the distal section of the locking ridge passes through the upper channel section.

In a third separate aspect of the present invention, a floating floor system includes a plurality of floor panels, each of the floor panels including: a base layer formed of a first material having a first hardness; a first locking edge portion formed from the base layer and having a first locking profile which includes a first horizontal locking feature and a first vertical locking feature; a second locking edge portion formed from the base layer and having a second locking profile which includes a second horizontal locking feature and a second vertical locking feature; a third locking edge portion formed from the base layer and having a third locking profile which includes a third horizontal locking feature; a fourth locking edge portion formed from the base layer and having a fourth locking profile which includes a fourth horizontal locking feature; and the third and fourth horizontal locking features each include a substantially horizontal wall and a substantially vertical wall, and at least one of the substantially horizontal wall and the substantially vertical wall of at least one of the third and fourth horizontal locking features is formed of a second material having a second hardness which is lower than the first hardness. The floor panels are arranged in a mechanical interlocked arrangement such that: the first locking edge portions of the floor panels mate with the second locking edge portions of adjacent ones of the floor panels, the first and second horizontal locking features mate with one another to prevent horizontal separation between the adjacent ones of the floor panels, the first and second vertical locking features mate with one another to prevent vertical separation between the adjacent ones of the floor panels, the third locking edge portions of the floor panels mate with the fourth locking edge portions of adjacent ones of the floor panels, and the third and fourth horizontal locking features mate with one another to prevent horizontal separation between the adjacent ones of the floor panels.

In a fourth separate aspect of the present invention, a floating floor system includes a plurality of floor panels, each of the floor panels including: a base layer formed of a first material having a first hardness; a first locking edge portion formed from the base layer and having a first locking profile which includes a first horizontal locking feature; a second locking edge portion formed from the base layer and having a second locking profile which includes a second horizontal locking feature; and the first and second horizontal locking features each include a substantially horizontal wall and a substantially vertical wall, and at least one of the substantially horizontal wall and the substantially vertical wall of at least one of the first and second horizontal locking features is formed of a second material having a second hardness which is lower than the first hardness. The floor panels are arranged in a mechanical interlocked arrangement such that: the first locking edge portions of the floor panels mate with the second locking edge portions of adjacent ones of the floor panels, and the first and second horizontal locking features mate with one another to prevent horizontal separation between the adjacent ones of the floor panels.

In a fifth separate aspect of the present invention, an interlocking floor panel includes: a base layer formed of a first material having a first hardness; a first locking edge portion formed from the base layer and having a first locking profile which includes a first horizontal locking feature and a first vertical locking feature; a second locking edge portion formed from the base layer and having a second locking profile which includes a second horizontal locking feature and a second vertical locking feature; a third locking edge portion formed from the base layer and having a third locking profile which includes a third horizontal locking feature; a fourth locking edge portion formed from the base layer and having a fourth locking profile which includes a fourth horizontal locking feature; and the third and fourth horizontal locking features each include a substantially horizontal wall and a substantially vertical wall, and at least one of the substantially horizontal wall and the substantially vertical wall of at least one of the third and fourth horizontal locking features is formed of a second material having a second hardness which is lower than the first hardness.

Accordingly, an improved interlocking floor panel and flooring system are disclosed. Advantages of the improvements will be apparent from the drawings and the description of the preferred embodiment.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION

Figure 1A:
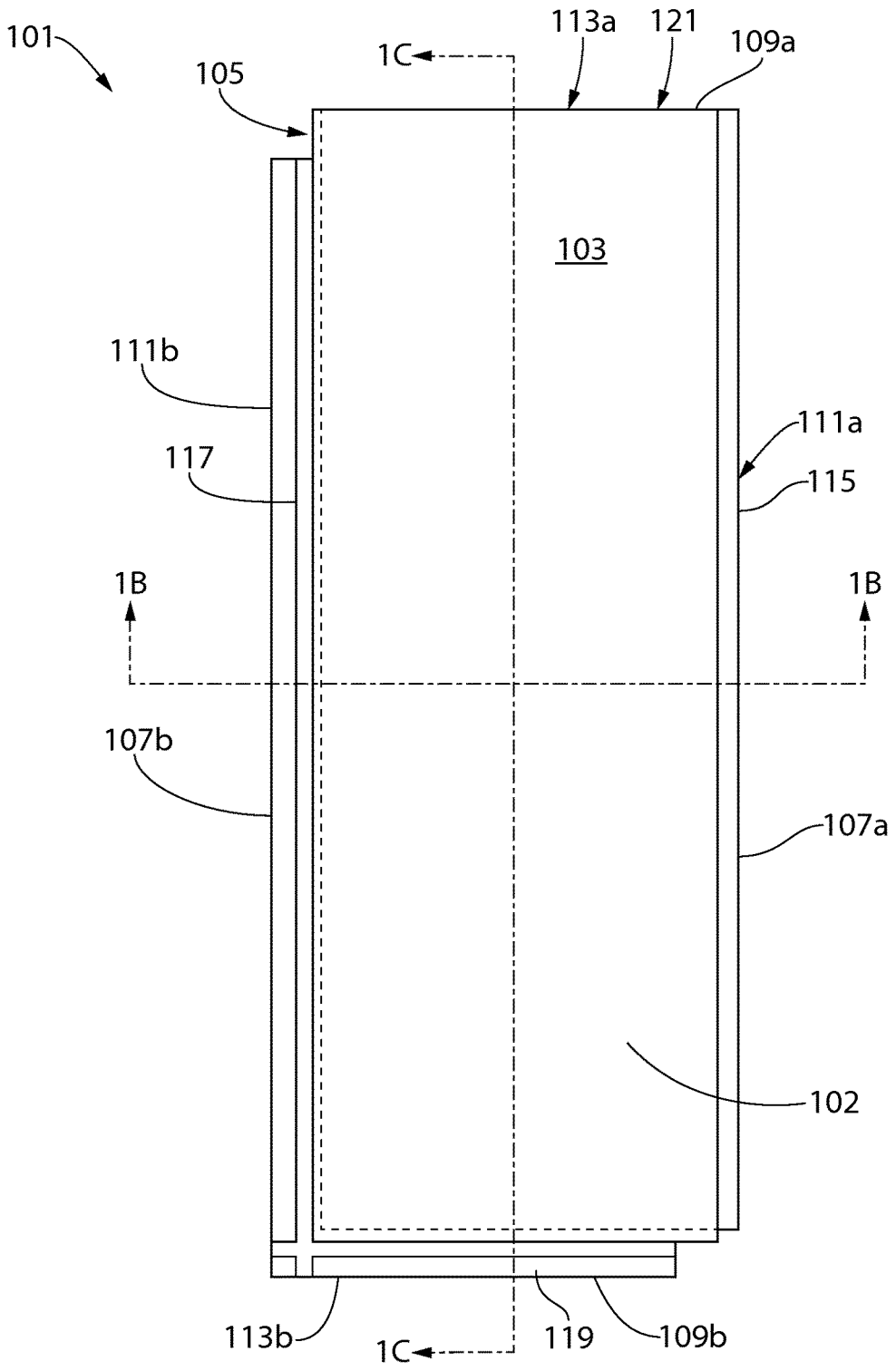
FIG. 1A shows a top plan view of an interlocking floor panel having portions of at least one interlocking edge formed of a material that is more resilient than the base layer.

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments.

As used herein, the terms "panel", "tile", and "board" may be used interchangeably, and where there is a size or compositional difference, the difference will be expressly stated.

As used herein, the terms "body" and "main body" may be used interchangeably.

Turning to FIG. 1A, a rectangular floor panel 101 is shown. In this exemplary embodiment, the main body 102 of the floor panel 101 includes a top surface 103 with a surface area similar to the bottom surface 105. The floor panel 101 as shown has long edges 107*a*, 107*b* and short edges 109*a*, 109*b*. Each of the long edges 107*a*, 107*b* has a locking edge portion 111*a*, 111*b*, which extend from respective opposite sides of the main body 102, and each of the short edges 109*a*, 109*b* has a locking edge portion 113*a*, 113*b*, which also extend from respective opposite sides of the main body 102. The locking edge portion 111*a* includes a first locking profile 115, and the locking edge portion 111*b* includes a second locking profile 117. Each locking profile 115, 117 is complementary in shape to the other locking profile 115, 117, respectively, so that the first locking profile 115 of a first floor panel may couple in locking engagement with the second locking profile 117 of a second floor panel. Similarly, the locking edge portion 113*a* includes a first locking profile 119, and the locking edge portion 113*b* includes a second locking profile 121. Each locking profile 119, 121 is complementary in shape to the other locking profile 119, 121, respectively, so that the locking profile 119 of a first floor panel may couple in locking engagement with the locking profile 121 of a second floor panel.

In certain embodiments, one of the long edges 107*a*, 107*b* or the short edges 109*a*, 109*b* may be configured to be of the "fold-and-lock" type, and the other of long edges 107*a*, 107*b* and the short edges 109*a*, 109*b* may be configured as a "push-and-lock" type. Both types of locking engagement edge profiles are well known in the art, and either type may be placed along the short edge or the long edge of a floor panel.

The length ratio of the long edges 107*a*, 107*b* of the floor panel 101 to the short edges 109*a*, 109*b* of the floor panel 101 may vary in accordance with design choice. In certain embodiments, the long edges 107*a*, 107*b* may be significantly longer than the short edges 109*a*, 109*b*, and in other embodiments, all four edges 107*a*, 107*b*, 109*a*, 109*b* may be of equal length. When all four edges are equal, the locking profiles are the only features which distinguish the 'long edges' from the 'short edges'.

Figure 1B:
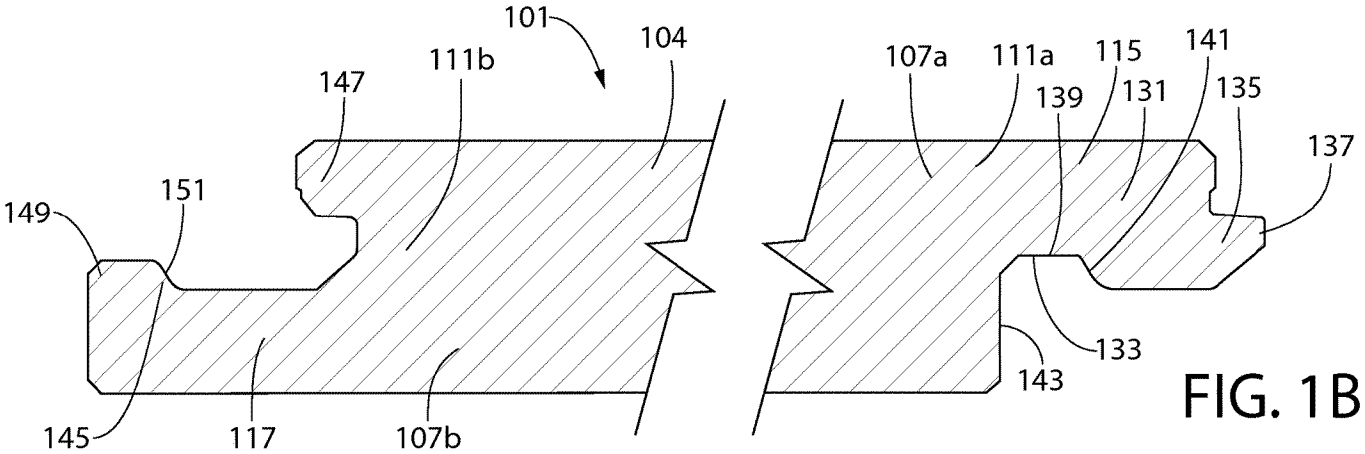
FIG. 1B shows a sectional view of the floor panel along the line 1B-1B of FIG. 1A.

As shown in FIG. 1B, the first locking profile 115 of the first long edge 107*a* includes a horizontal locking feature 131, which is formed as part of a channel 133 in the locking profile 115, and a vertical locking feature 135, which is formed as an outward extending tongue 137. The channel 133 is formed from a channel floor 139, an outer wall surface 141, and an inner wall surface 143. In this embodiment, the outer wall surface 141 forms the horizontal locking feature 131.

The locking profile 117 of the second long edge 107*b* includes a horizontal locking feature 145, which is formed to be complementary in shape to the horizontal locking feature 131 of the locking profile 115 of the first long edge 107*a*, and a vertical locking feature 147, which is formed to be complementary in shape to the vertical locking feature 135 of the locking profile 115 of the first long edge 107*a*. The locking profile 117 also includes a vertical ridge 149, which includes an inner wall surface 151 and is formed to be complementary to, and to mate with, the channel 133 of the locking profile 115. In this embodiment, the inner wall surface 151 forms the horizontal locking feature 145. Thus, one floor panel having the first locking profile along a long edge may be coupled in both locking engagement with a second floor panel having the second locking profile along a long edge. The two locking profiles 115, 117 along the long edges 107*a*, 107*b* are configured to provide horizontal and vertical locking engagement in a manner that is known in the art, such as being configured for "fold-to-lock" engagement.

Figure 1C:
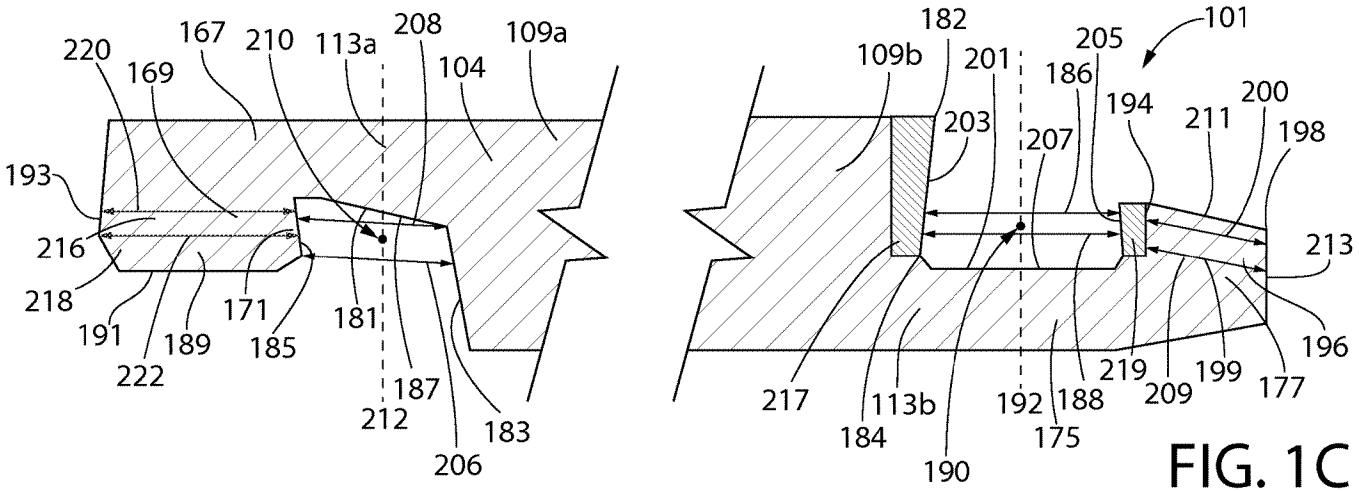
FIG. 1C shows a sectional view of the floor panel along the line 1C-1C of FIG. 1A.

FIG. 1C shows the locking edge profiles 119, 121 of the first short edge 109*a* and the second short edge 109*b*, respectively. The main body 102 is formed from a base layer 104. While the base layer 104 is exemplified as a single layer construct, in certain embodiments, the base layer 104 can be a multi-layer construct.

Figure 2:
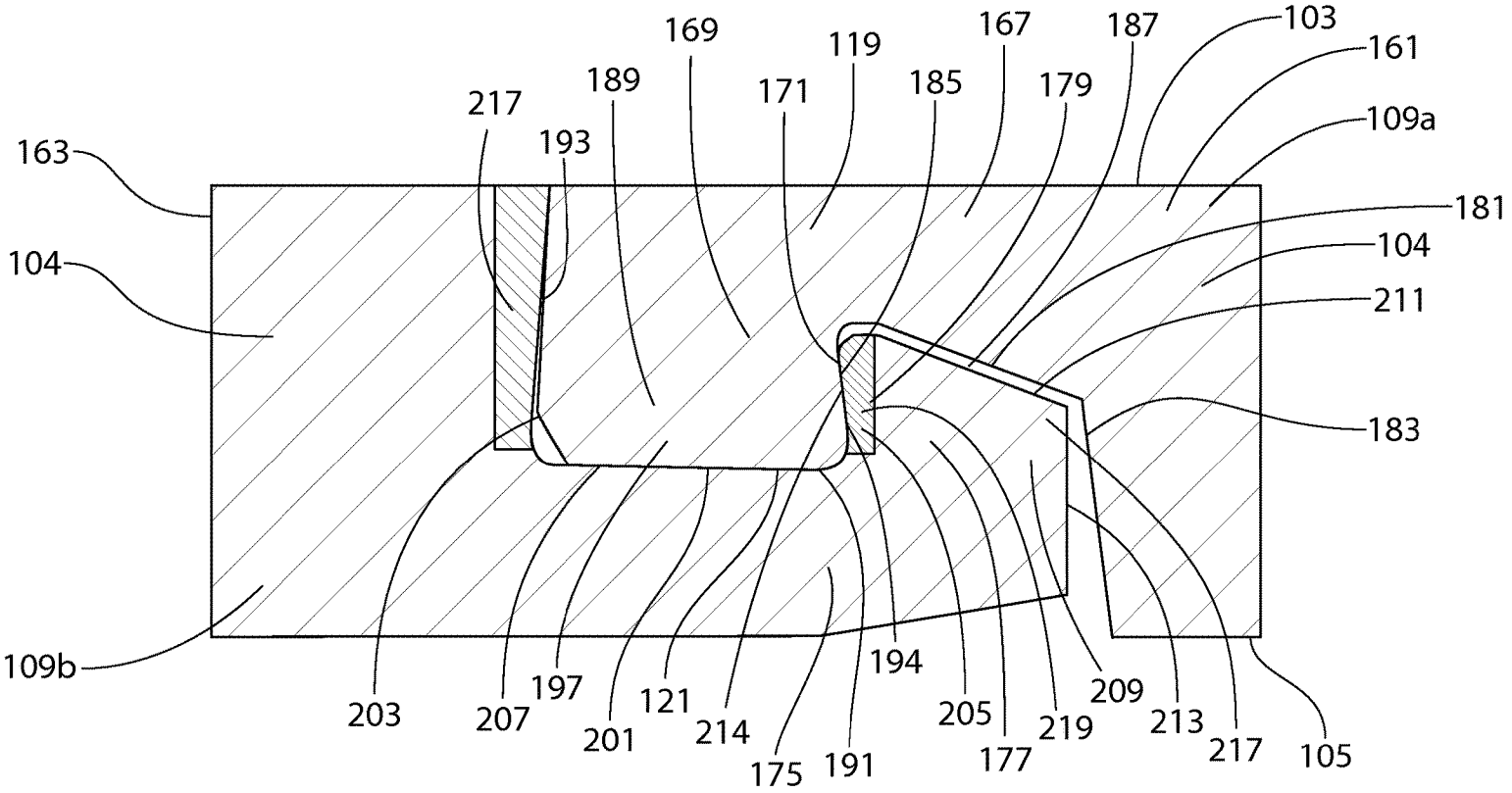
FIG. 2 shows a sectional view of the short edges of two adjacent floor panels according to a first embodiment.

FIG. 2 shows the same locking edge profiles 119, 121, each included as part of two separate and identically constructed floor panels 161, 163. Each of the two floor panels 161, 163 are constructed as shown in FIGS. 1A-C. In FIG. 2, the floor panels 161, 163 are mated in locking engagement along the respective short edges 109*a*, 109*b*.

Referring to FIGS. 1C and 2 collectively, the locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179. In certain embodiments, the horizontal locking features 169, 177 and the vertical locking features 171, 179 may share common structural elements in each respective locking edge profile 119, 121.

The horizontal locking features 169 and the vertical locking features 171 of the locking edge portion 167 are integrated in the embodiment shown and incorporated into a locking channel 181 which is formed from an first channel sidewall 183, a second channel sidewall 185, and a channel floor 187. The first and second channel sidewalls 183, 185 each extend away from the channel floor 187 toward the bottom surface 105. The locking channel 181 also includes an upper channel section 182, which is defined by upper portions of the first and second channel sidewalls 183, 185, and a lower channel section 184, which is defined by lower portions of the first and second channel sidewalls 183, 185. The upper channel section 182 has a first channel width 186, and the lower channel section 184 has a second channel width 188, such that the first channel width 186 is less than the second channel width 188.

The locking channel 181 extends along a channel axis 190 (orthogonal to the plane of the page) which lies within a channel reference plane 192, and the channel reference plane 192 is substantially perpendicular to the top surface 103 of the floor panel 101. The first channel sidewall 183 converges with top surface 103 of the main body 102 to form an upper peripheral edge of the floor panel 101. The second channel sidewall 185, which is located opposite the first channel sidewall 183, extends upward from the channel floor 187 at an oblique angle with respect to the channel reference plane 192. This configuration aids in securing both horizontal and vertical locking for adjacent floor tiles.

The horizontal locking features 169 and the vertical locking features 141 are also incorporated into a locking ridge 189, which protrudes downward away from the top surface 103. The locking ridge 189 is formed from a first ridge sidewall 194 (which in the embodiment shown is the same as the second channel sidewall 185), a ridge top surface 191, and a second ridge sidewall 193. In certain embodiments, the second channel sidewall 185 and the first ridge sidewall 194 may be separate and distinct structural elements of the locking edge profile 119. The locking ridge 189 also includes a base section 196, which is defined by upper portions of the first and second ridge sidewalls 194, 193, and a distal section 198, which is defined by lower portions of the first and second ridge sidewalls 194, 193. The base section 196 has a first ridge width 199, and the distal section has a second ridge width 200, such that the first ridge width 199 is less than the second ridge width 200.

The base layer 104 of the floor panel 101, which forms a substantial portion of the locking edge portion 167, is formed out of a first material having a first hardness. In certain embodiments, at least one of the channel floor 187, the first channel sidewall 183, the second channel sidewall 185, the ridge top surface 191, the first ridge sidewall 194, and the second ridge sidewall 193 includes a portion formed of a second material having a second hardness, with the second hardness being lower than the first hardness. In certain other embodiments, at least one of the upper portion of the first channel sidewall 183, the upper portion of the second channel sidewall 185, the upper portion of the first ridge sidewall 194, and the upper portion of the second ridge sidewall 193 is formed from the second material. In still other embodiments, at least a portion of each of the ridge top surface 191, the first ridge sidewall 194, and the second ridge sidewall 193 is formed from the second material.

In certain embodiments, the first material may be a rigid material. Suitable rigid materials may include high density fiberboard, medium density fiberboard, engineered wood, hardwood, and combinations thereof. In certain such embodiments, the base layer 104 may be a multi-layer construct (i.e., a laminate flooring panel) of the first materials listed above. In still other embodiments, the first material may be a somewhat flexible material, such as a vinyl composition commonly used in luxury vinyl tiles, so long as said flexible material of the first material has a greater degree of rigidity compared to the selected second material (discussed below).

In certain embodiments, the second material is a resilient (i.e., elastomeric) material and may be flexible and/or compressible. Suitable elastomeric materials include rubber, an elastomer, elastomeric thermoplastics, foam, cork, foamed polymeric materials, and the like. In other embodiments, the second material may be a flexible adhesive, such as a flexible and compressible acrylic adhesive or a flexible and compressible silicone laminating adhesive, such as FLEX-mount A-374 or Densil LTS-1 adhesives.

Of course, the invention is not so limited and a wide variety of first and second materials can be used as would be understood by those of skill in the art.

As mentioned above, the first material has a first hardness and the second material has a second hardness, wherein the first hardness if greater than the second hardness. Thus in certain embodiments, the first and second materials can be selected and defined in terms of relative hardness rather than material type, so long as the first hardness is greater than the second hardness. In one such embodiment, the first hardness may be in a range of 5 to 70 Shore A hardness, with 15 to 55 Shore A hardness being possibly preferred. In certain embodiments, the second hardness is greater than 85 lbf wherein hardness in this instance is tested in accordance with ASTM C367-95.

In certain embodiments, one or more of the channel floor 187, the ridge top surface 191, the first channel sidewall 183, the second channel sidewall 185, the first ridge sidewall 194 and the second ridge sidewall 193 of the locking edge portion 167 may be formed as oblique surfaces or walls, respectively, with respect to the top surface 103 of the floor panel 101. One or more obliquely formed surfaces or walls included as part of the locking edge portion 175 may help provide at least one of horizontal locking and vertical locking between adjacent floor panels.

The horizontal locking features 177 and the vertical locking features 179 of the locking edge portion 175 are integrated in the embodiment shown and incorporated into a locking channel 201 formed from an first channel sidewall 203, a second channel sidewall 205, and a channel floor 207. The first and second channel sidewalls 203, 205 each extend away from the channel floor 207 toward the top surface 103. The locking channel 201 also includes an upper channel section 202, which is defined by upper portions of the first and second channel sidewalls 203, 205, and a lower channel section 204, which is defined by lower portions of the first and second channel sidewalls 203, 205. The upper channel section 202 has a first channel width 206, and the lower channel section 204 has a second channel width 208, such that the first channel width 206 is less than the second channel width 208.

The locking channel 201 extends along a channel axis 210 (orthogonal to the plane of the page) which lies within a channel reference plane 212, and the channel reference plane 212 is substantially perpendicular to the top surface 103 of the floor panel 101. The first channel sidewall 203 converges with the bottom surface 105 of the main body 102 to form a lower peripheral edge of the floor panel 101. The second channel sidewall 205, which is located opposite the first channel sidewall 203, extends downward from the channel floor 207 at an oblique angle with respect to the channel reference plane 212. This configuration aids in securing both horizontal and vertical locking for adjacent floor tiles.

The horizontal locking features 177 and the vertical locking features 179 are also incorporated into a locking ridge 209, which protrudes upward away from the bottom surface 105. The locking ridge 209 is formed from a first ridge sidewall 214 (which in the embodiment shown is the same as the second channel sidewall 205), a ridge top surface 211, and a second ridge sidewall 213. In certain embodiments, the second channel sidewall 205 and the first ridge sidewall 214 may be separate and distinct structural elements of the locking edge profile 121. The locking ridge 209 also includes a base section 216, which is defined by upper portions of the first and second ridge sidewalls 214, 213, and a distal section 218, which is defined by lower portions of the first and second ridge sidewalls 214, 213. The base section 216 has a first ridge width 220, and the distal section 218 has a second ridge width 222, such that the first ridge width 220 is less than the second ridge width 222. In certain embodiments, the second ridge width 222 of the locking edge portion 175 is greater than the first channel width 186 of the locking edge portion 167.

The base layer 104 of the floor panel 101, which forms a substantial portion of the locking edge portion 175, is formed out of the first material having a first hardness. The first channel sidewall 203 and the second channel sidewall 205 each respectively include a secondary material layers 217, 219 which are formed out of a second material having a second hardness, with the second hardness being lower than the first hardness. In certain embodiments, at least one of the channel floor 207, the first channel sidewall 203, the second channel sidewall 205, the ridge top surface 211, the first ridge sidewall 214, and the second ridge sidewall 213 includes a portion formed of the second material. In certain other embodiments, at least one of the upper portion of the first channel sidewall 203, the upper portion of the second channel sidewall 205, the upper portion of the first ridge sidewall 214, and the upper portion of the second ridge sidewall 213 is formed from the second material. In yet other embodiments, each of the upper portions of the first and second channel sidewalls 203, 205 are formed of the second material. In still other embodiments, each of the upper portions of the first and second ridge sidewalls 214, 213 are formed of the second material. In still other embodiments, at least a portion of each of the ridge top surface 211, the first ridge sidewall 214, and the second ridge sidewall 213 is formed from the second material.

The walls and surfaces which are formed of the second material for the locking edge portion 167 may be selected independently of the walls and surfaces which are formed of the second material for the locking edge portion 175. However, at least one wall or surface of at least one of the locking edge portion 167 and the locking edge portion 175 is formed with the second material in order to gain one or more of the advantages discussed herein.

In certain embodiments, the channel floor 207, the ridge top surface 211, the first channel sidewall 203, the second channel sidewall 205, the first ridge sidewall 214, and the second ridge sidewall 213 are each formed as oblique surfaces or walls, respectively, with respect to the top surface 103 of the floor panel 101. One or more obliquely formed surfaces or walls included as part of the locking edge portion 175 may help provide at least one of horizontal locking and vertical locking between adjacent floor panels.

The second channel sidewalls 185, 205 of each respective locking edge portion 167, 175 provide horizontal locking, and the variance of the second channel sidewalls 185, 205 of each respective locking edge portion 167, 175 provide vertical locking. The secondary material layers 217, 219 facilitate interlocking of adjacent short edges 109*a*, 109*b* because of the lower hardness of these secondary material layers 217, 219, as compared to the respective base layers 195 of adjacent floor panels 101, provides areas of increased resiliency in each locking edge portion 167, 175 that is not otherwise present.

For example, for an embodiment in which at least one of the upper portion of the first channel sidewall 183, the upper portion of the second channel sidewall 185, the upper portion of the first ridge sidewall 214, and the upper portion of the second ridge sidewall 213 is formed from the second material, the second material compresses upon the distal section of the locking ridge 209 passing through the upper section of the locking channel 181 to allow the distal section of the locking ridge 209 to enter and nest in the lower section of the locking channel 181. In certain embodiments following this example, the portion of the at least one of the first channel sidewall 183, the second channel sidewall 185, the first ridge sidewall 214, and the second ridge sidewall 213 that is formed of the second material is placed into contact with and compressed by a surface that is formed of the first material in the mechanically interlocked arrangement.

In certain embodiments, the second material may be placed under continuous compression when adjacent floor panels are in the mechanically interlocked arrangement. For such embodiments, the compression of the second material may generate a counter force having a horizontal vector component that prevents vertical movement of the ridges within the channels when the plurality of floor panels are in the mechanically interlocked arrangement. In other embodiments, the second material may be provided with sufficient space in the mechanically interlocked arrangement to resiliently return to the non-interlocked form.

Figure 3:
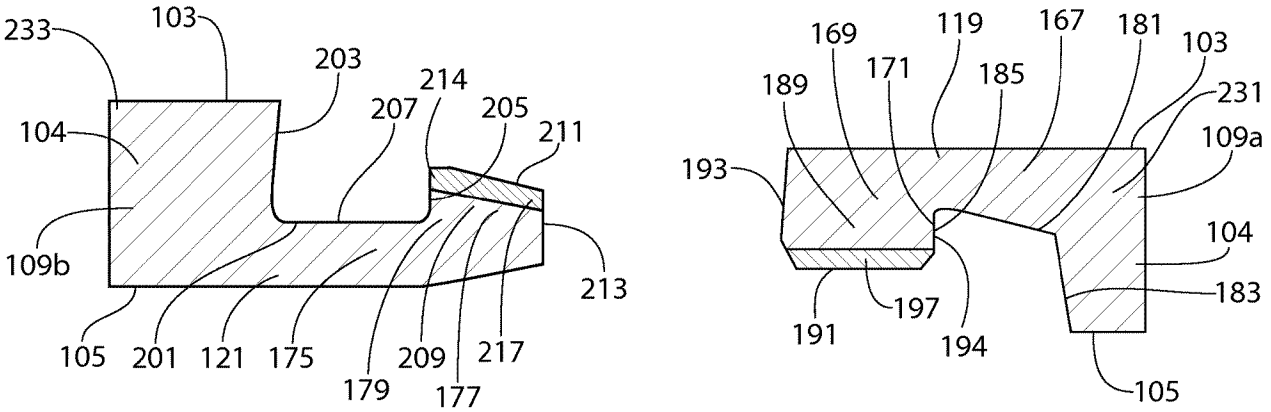
FIG. 3 shows a sectional view of the short edges of two adjacent floor panels according to a second embodiment.

Although the horizontal locking features 169, 177 and the vertical locking features 171, 179 of the respective short edges 109*a*, 109*b* are shown in FIGS. 1C, 2, and 3 as incorporated into and sharing some of the same structural elements of the respective locking edge profiles 119, 121, in certain embodiments, the horizontal locking features 169, 177 and the vertical locking features 171, 179 may formed from entirely distinct, and not shared, structural elements of the locking edge profiles 119, 121.

In certain embodiments, some of which are discussed in greater detail below, any number or combination of the horizontal walls and the vertical walls of one or both of the locking edge profiles 119, 121 may include a secondary material layer, where the secondary material layer is formed out of a second material having a second hardness, with the second hardness being lower than the first hardness of the base layer of the panel.

By including one or more secondary material layers on at least one of the horizontal walls and the vertical walls of at least one of the floor panels, the short edge of the floor panels may be enabled to enter into locking engagement more easily, i.e., with less force required at the time of installation for the "push-to-lock" engagement to be established, and in addition, the secondary material layer should serve to decrease noise produced by the floor installation as it ages.

For example, for floor panels having short edges configured as shown in FIG. 2, the locking ridges of the plurality of floor panels may be pressed into and nest within the locking grooves of adjacent ones of the plurality of floor panels. As the locking ridges are being pressed into the locking grooves, the portions formed of the second material are compressed, thereby achieving an interference fit between the first and second channel sidewalls and the first and second ridge sidewalls.

The floor panels in FIGS. 3-14 share the same essential structural features of the locking profiles as the floor panels depicted in FIG. 2. Therefore, in the ensuing description of FIGS. 3-14, like reference numerals are used for like structural features of the locking profile. It should be noted, however, that unless otherwise recited in the claims, the structural features of any of the embodiments described and depicted herein are not to be limiting of the invention.

FIG. 3 shows two short edges 109*a*, 109*b* of two adjacent floor panels 231, 233. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 231 is formed out of a first material having a first hardness. The ridge top surface 191 includes a secondary material layer 235 which is formed out of a second material having a second hardness, with the second hardness being lower than the first hardness. The second ridge sidewall 193 converges with the upper surface of the locking edge portion 167 to form an upper peripheral edge 221 of the floor panel 101.

The horizontal locking features 177 and the vertical locking features 179 of the locking edge portion 175 are incorporated into a locking channel 201 formed from an first channel sidewall 203, a second channel sidewall 205, and a channel floor 207. The first channel sidewall 203 converges with top surface 103 of the main body 102 to form an upper peripheral edge 223 of the floor panel 101.

The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 233 is formed out of the first material. The ridge top surface 211 includes a secondary material layer 237 which is formed out of the second material. In this embodiment, both of the upper peripheral edges 221, 223 are free of the second material.

The secondary material layers 235, 237 on the respective second channel sidewalls 185, 205 facilitate interlocking of adjacent short edges 109*a*, 109*b* because the lower hardness of the secondary material layers 235, 237, as compared to the respective base layers 195 of the adjacent floor panels 231, 233, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 4:
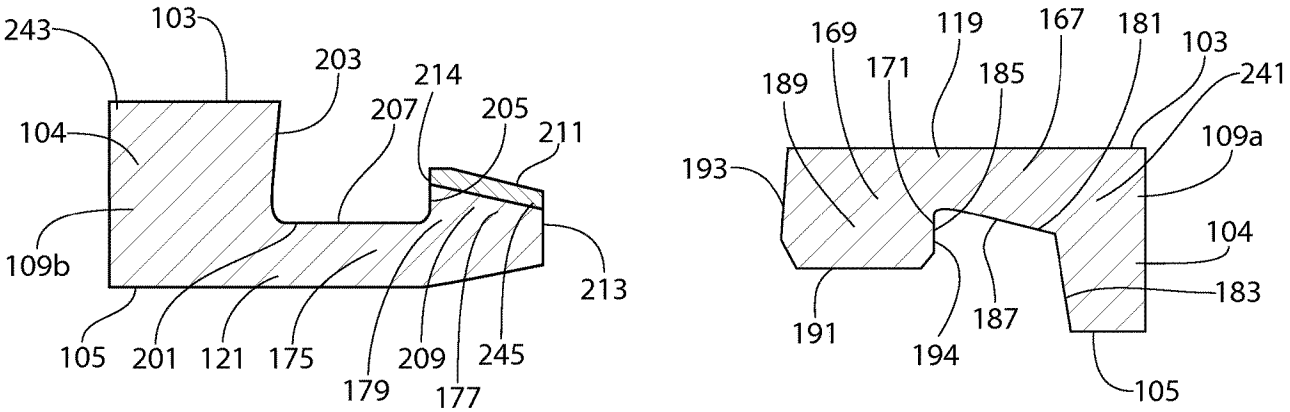
FIG. 4 shows a sectional view of the short edges of two adjacent floor panels according to a third embodiment.

FIG. 4 shows two short edges 109*a*, 109*b* of two adjacent floor panels 241, 243. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 241 is formed out of a first material having a first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 243 is formed out of the first material. The ridge top surface 211 includes a secondary material layer 245 which is formed out of a second material having a second hardness, with the second hardness being lower than the first hardness.

The secondary material layer 245 on the ridge top surface 211 facilitates interlocking of adjacent short edges 109*a*, 109*b* because the lower hardness of the secondary material layer 245, as compared to the respective base layers 195 of the adjacent floor panels 241, 243, provides an area of increased resiliency in the locking edge portion 175 that is not otherwise present. This area of increased resiliency may be compressed during the process of engagement, thereby facilitating adjacent floor panels entering into locking engagement. The areas of increased resiliency should serve to decrease noise produced by the floor installation as it ages.

Figure 5:
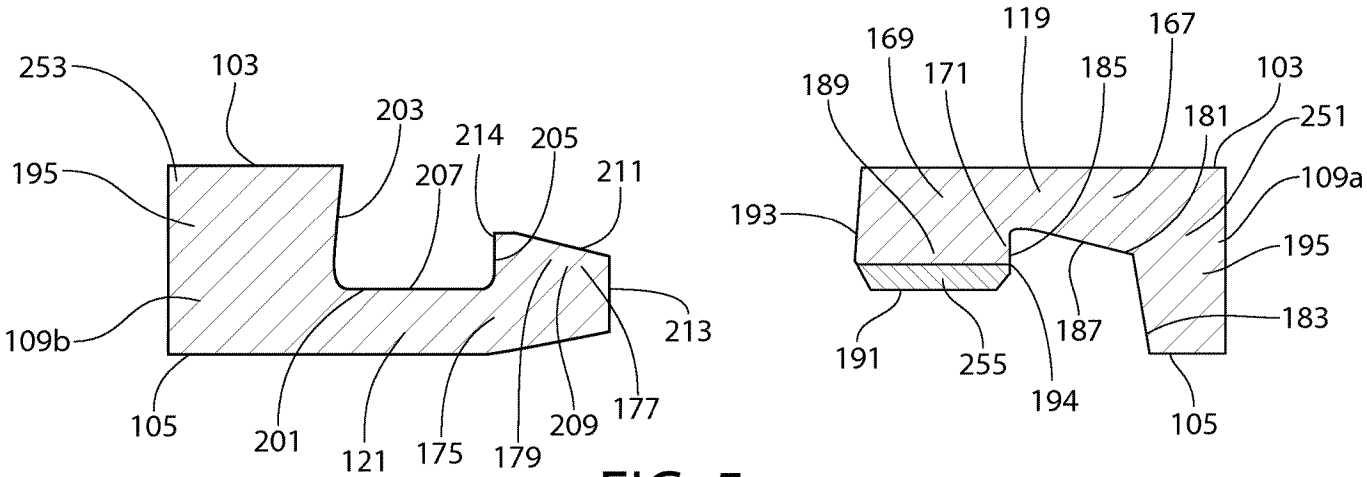
FIG. 5 shows a sectional view of the short edges of two adjacent floor panels according to a fourth embodiment.

FIG. 5 shows two short edges 109*a*, 109*b* of two adjacent floor panels 251, 253. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 251 is formed out of a first material having a first hardness. The ridge top surface 191 includes a secondary material layer 255 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 253 is formed out of the first material.

The secondary material layer 255 on the ridge top surface 191 facilitates interlocking of adjacent short edges 109*a*, 109*b* because the lower hardness of the secondary material layer 255, as compared to the respective base layers 195 of the adjacent floor panels 251, 253, provides an area of increased resiliency in the locking edge portion 167 that is not otherwise present. This area of increased resiliency may be compressed during the process of engagement, thereby facilitating adjacent floor panels entering into locking engagement. The areas of increased resiliency should serve to decrease noise produced by the floor installation as it ages.

Figure 6:
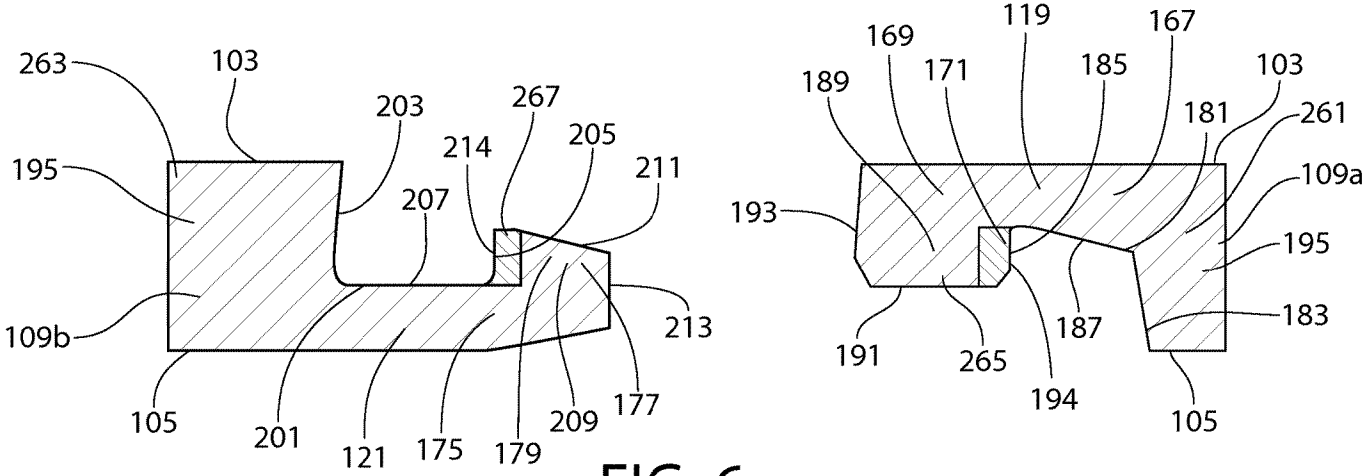
FIG. 6 shows a sectional view of the short edges of two adjacent floor panels according to a fifth embodiment.

FIG. 6 shows two short edges 109*a*, 109*b* of two adjacent floor panels 261, 263. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 261 is formed out of a first material having a first hardness. The second channel sidewall 185 includes a secondary material layer 265 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 263 is formed out of the first material. The second channel sidewall 205 includes a secondary material layer 267 which is formed out of the second material.

In this embodiment, both of the second channel sidewall 205 and the first ridge sidewall 194 are formed entirely of the first material, such that for adjacent ones of the plurality of floor panels in the mechanically interlocked arrangement, the second channel sidewalls 205 mate with the first ridge sidewalls 194.

The secondary material layers 265, 267 on the respective second channel sidewalls 185, 205 facilitate interlocking of adjacent short edges 109*a*, 109*b* because the lower hardness of the secondary material layers 265, 267, as compared to the respective base layers 195 of the adjacent floor panels 261, 263, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 7:
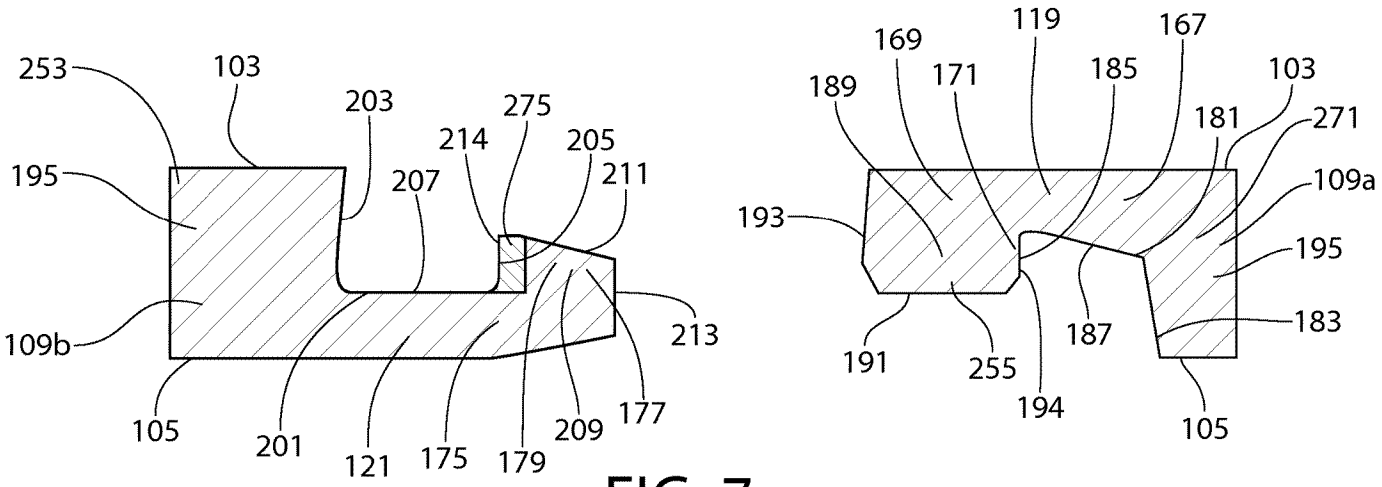
FIG. 7 shows a sectional view of the short edges of two adjacent floor panels according to a sixth embodiment.

FIG. 7 shows two short edges 109*a*, 109*b* of two adjacent floor panels 271, 273. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The first channel sidewall 183 converges with top surface 103 of the main body 102 to form an upper peripheral edge 221 of the floor panel 101.

The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 271 is formed out of a first material having a first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 273 is formed out of the first material. The second channel sidewall 205 includes a secondary material layer 275 which is formed out of a second material having a second hardness, with the second hardness being lower than the first hardness.

The second ridge sidewall 193, which is located opposite the first ridge sidewall 194, converges with the upper surface of the locking edge portion 167 to form an upper peripheral edge 223 of the floor panel 101. In embodiments where one of the second channel sidewall 205 and the first ridge sidewall 194 is formed from the second material and the other one of the second channel sidewall 205 and the first ridge sidewall 194 is formed from the first material (see FIGS. 7 and 8, respectively), for adjacent ones of the floor panels 101 in the mechanically interlocked arrangement, the second channel sidewalls 205 mate with the first ridge sidewalls 194 to compress the second material that forms the one of the second channel sidewall 205 and the first ridge sidewall 194.

The secondary material layer 275 on the second channel sidewall 205 facilitates interlocking of adjacent short edges 109*a*, 109*b* because the lower hardness of the secondary material layer 275, as compared to the respective base layers 195 of the adjacent floor panels 271, 283, provides an area of increased resiliency in the locking edge portion 167 that is not otherwise present. This area of increased resiliency may be compressed during the process of engagement, thereby facilitating adjacent floor panels entering into locking engagement. The areas of increased resiliency should serve to decrease noise produced by the floor installation as it ages.

Figure 8:
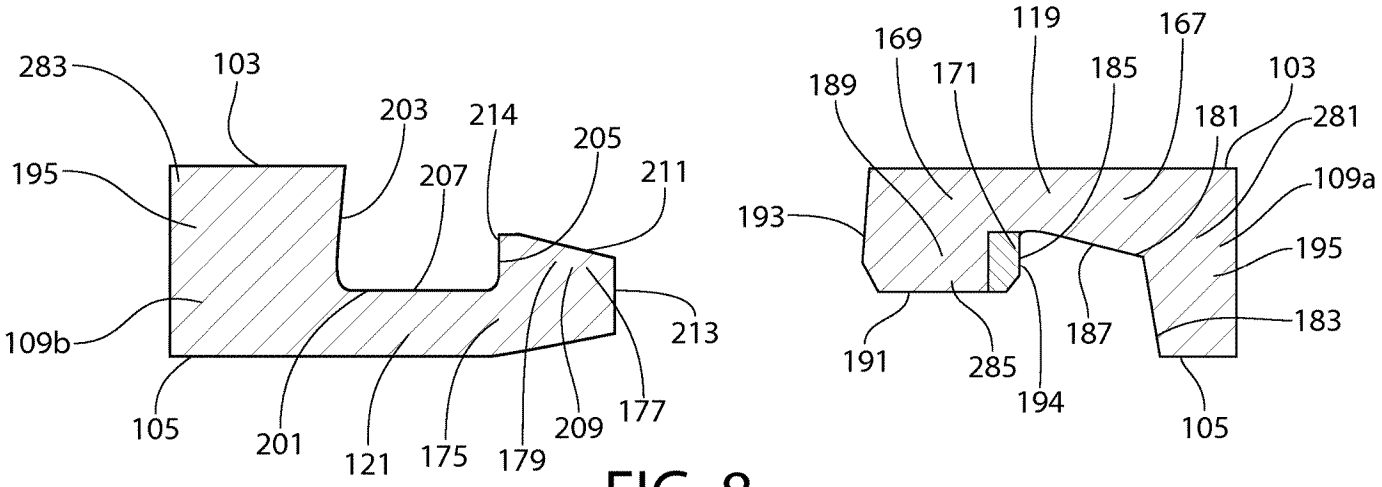
FIG. 8 shows a sectional view of the short edges of two adjacent floor panels according to a seventh embodiment.

FIG. 8 shows two short edges 109*a*, 109*b* of two adjacent floor panels 281, 283. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 281 is formed out of a first material having a first hardness. The second channel sidewall 185 includes a secondary material layer 285 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 283 is formed out of the first material.

The secondary material layer 285 on the second channel sidewall 185 facilitates interlocking of adjacent short edges 109*a*, 109*b* because the lower hardness of the secondary material layer 285, as compared to the respective base layers 195 of the adjacent floor panels 281, 283, provides an area of increased resiliency in the locking edge portion 167 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 9:
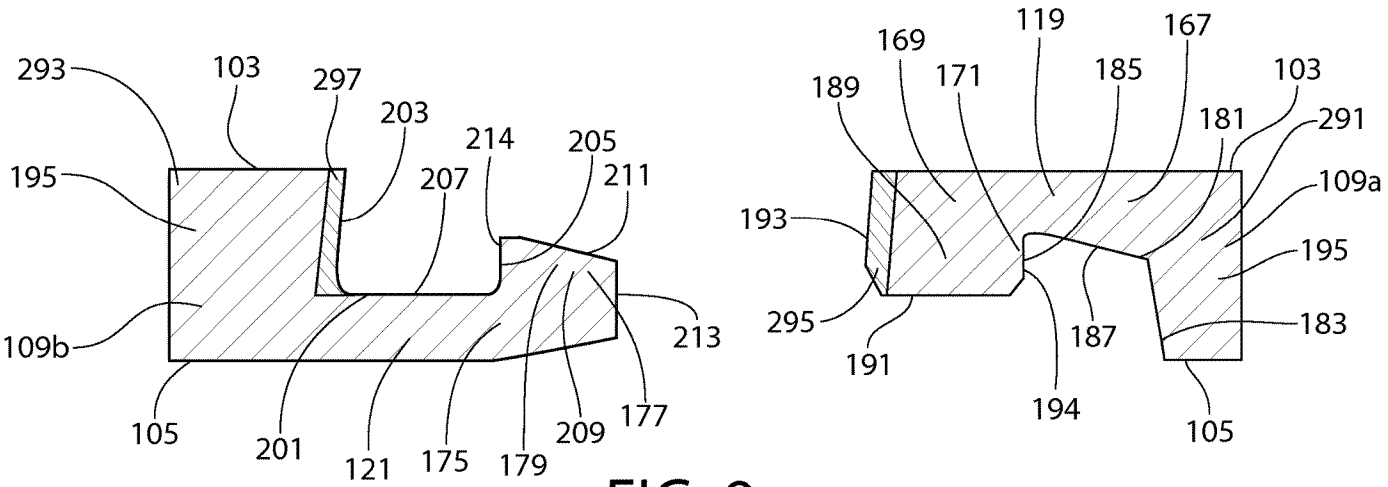
FIG. 9 shows a sectional view of the short edges of two adjacent floor panels according to a eighth embodiment.

FIG. 9 shows two short edges 109*a*, 109*b* of two adjacent floor panels 291, 293. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 291 is formed out of a first material having a first hardness. The second ridge sidewall 193 includes a secondary material layer 295 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 293 is formed out of the first material. The first channel sidewall 203 includes a secondary material layer 297 which is formed out of the second material.

The secondary material layer 195, 297 on the respective external ridge wall 193 and the internal channel wall 203 facilitate interlocking of adjacent short edges 109*a*, 109*b* because the lower hardness of the secondary material layers 295, 297, as compared to the respective base layers 195 of the adjacent floor panels 291, 293, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 10:
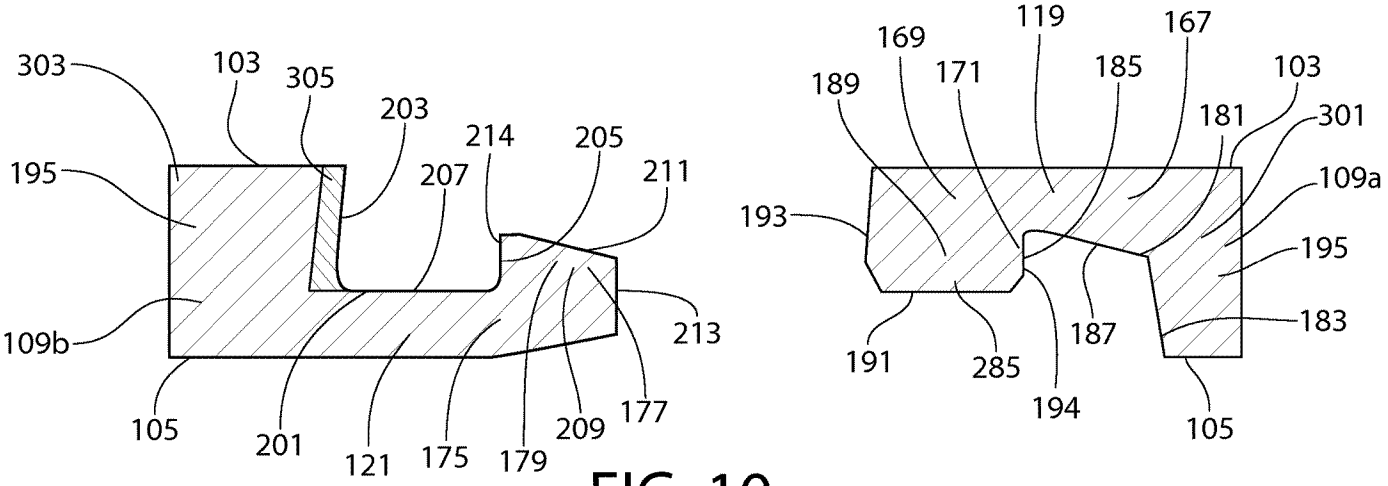
FIG. 10 shows a sectional view of the short edges of two adjacent floor panels according to a ninth embodiment.

FIG. 10 shows two short edges 109*a*, 109*b* of two adjacent floor panels 301, 303. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 301 is formed out of a first material having a first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 303 is formed out of the first material. The first channel sidewall 203 includes a secondary material layer 335 which is formed out of the second material.

The secondary material layer 305 on the first channel sidewall 203 facilitates interlocking of adjacent short edges 109*a*, 109*b* because the lower hardness of the secondary material layer 305, as compared to the respective base layers 195 of the adjacent floor panels 301, 303, provides an area of increased resiliency in the locking edge portion 175 that is not otherwise present. This area of increased resiliency may be compressed during the process of engagement, thereby facilitating adjacent floor panels entering into locking engagement. The areas of increased resiliency should serve to decrease noise produced by the floor installation as it ages.

Figure 11:
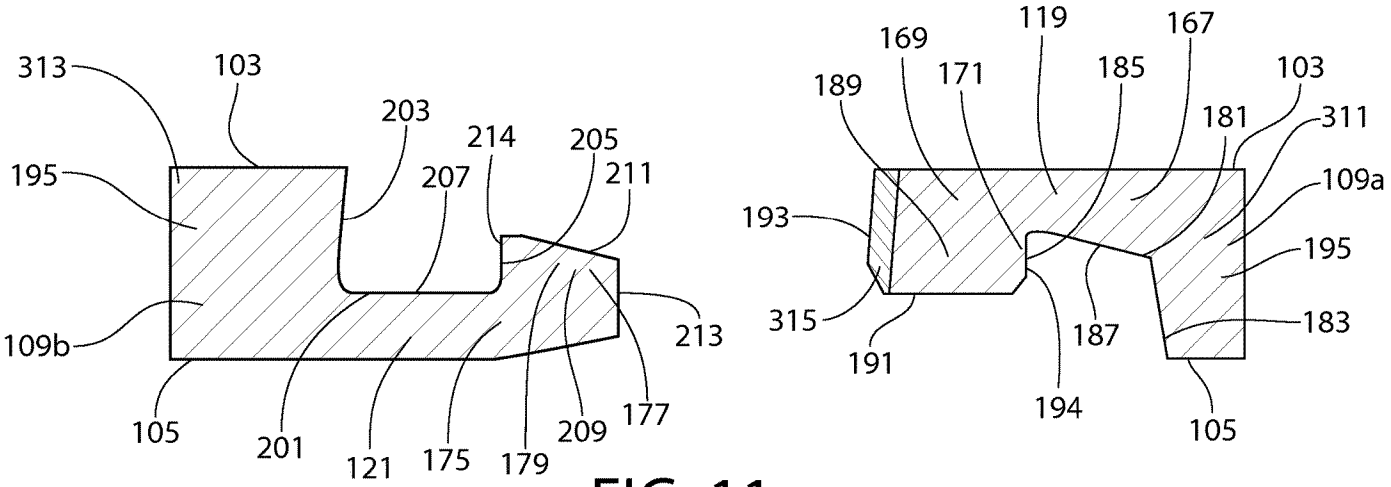
FIG. 11 shows a sectional view of the short edges of two adjacent floor panels according to a tenth embodiment.

FIG. 11 shows two short edges 109*a*, 109*b* of two adjacent floor panels 311, 313. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 311 is formed out of a first material having a first hardness. The second ridge sidewall 193 includes a secondary material layer 315 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 313 is formed out of the first material.

The secondary material layer 315 on the second ridge sidewall 193 facilitates interlocking of adjacent short edges 109*a*, 109*b* because the lower hardness of the secondary material layer 315, as compared to the respective base layers 195 of the adjacent floor panels 311, 313, provides an area of increased resiliency in the locking edge portions 167 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 12:
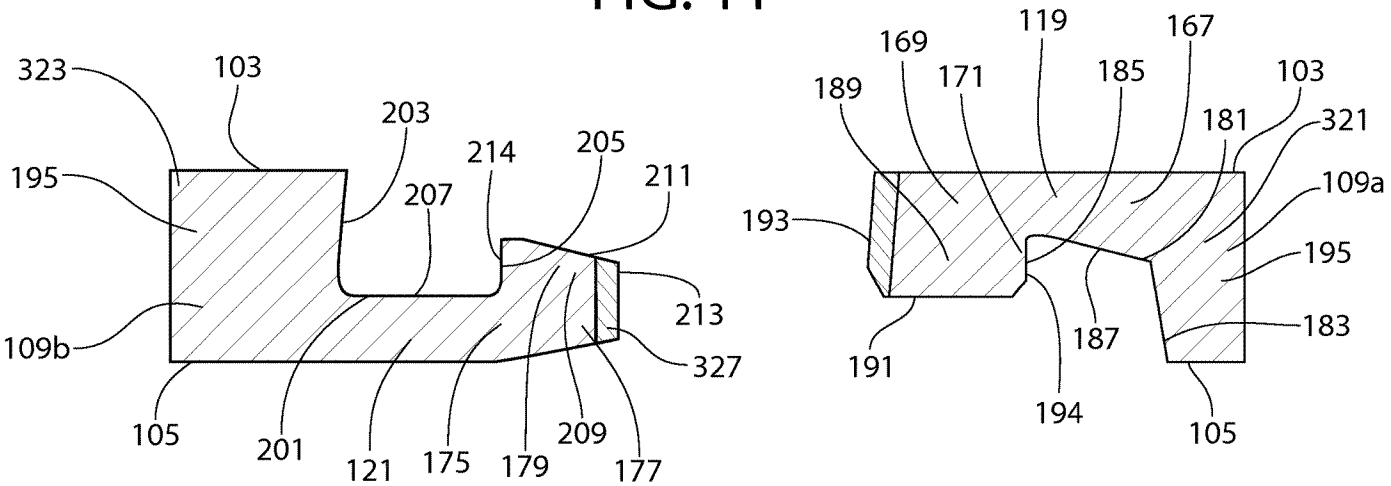
FIG. 12 shows a sectional view of the short edges of two adjacent floor panels according to a eleventh embodiment.

FIG. 12 shows two short edges 109*a*, 109*b* of two adjacent floor panels 321, 323. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 321 is formed out of a first material having a first hardness. external ridge wall 193 includes a secondary material layer 335 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 323 is formed out of the first material. The second ridge sidewall 213 includes a secondary material layer 337 which is formed out of the second material.

The secondary material layers 335, 337 on the respective external ridge walls 193, 213 facilitate interlocking of adjacent short edges 109*a*, 109*b* because the lower hardness of the secondary material layers 335, 337, as compared to the respective base layers 195 of the adjacent floor panels 321, 323, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 13:
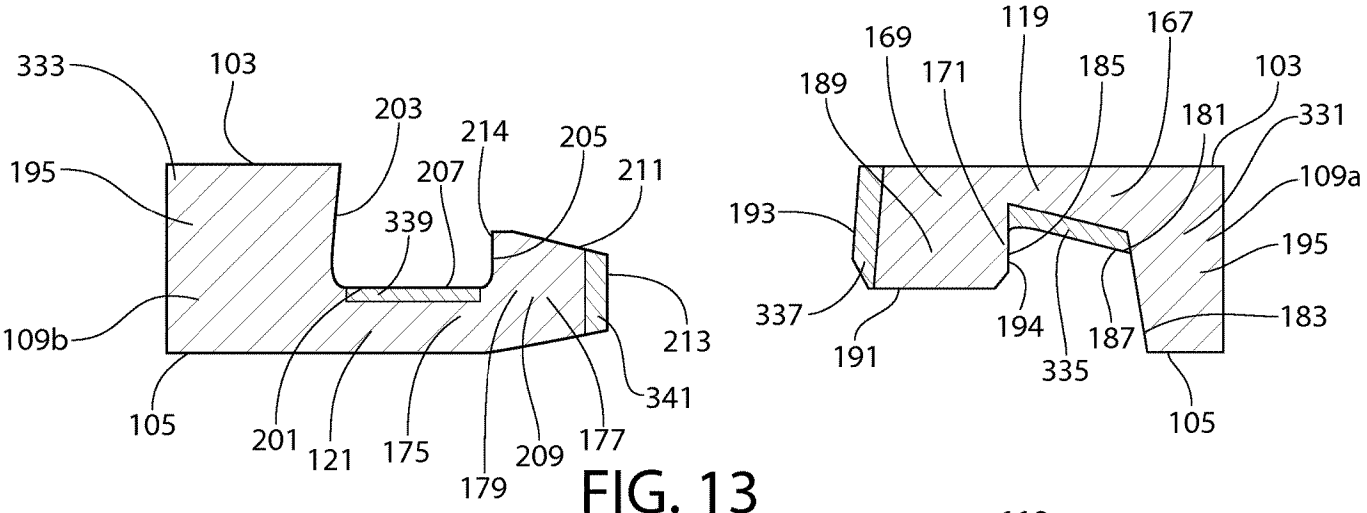
FIG. 13 shows a sectional view of the short edges of two adjacent floor panels according to a twelfth embodiment.

FIG. 13 shows two short edges 109*a*, 109*b* of two adjacent floor panels 331, 333. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 331 is formed out of a first material having a first hardness. The channel floor 187 and the second ridge sidewall 193 each respectively include a secondary material layer 335, 337 which are formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 333 is formed out of the first material. The channel floor 207 and the second ridge sidewall 213 each respectively include a secondary material layers 339, 341 which are formed out of the second material.

The secondary material layers 335, 337, 339, 341 facilitate interlocking of adjacent short edges 109*a*, 109*b* because the lower hardness of the secondary material layers 335, 337, 339, 341, as compared to the respective base layers 195 of the adjacent floor panels 341, 343, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 14:
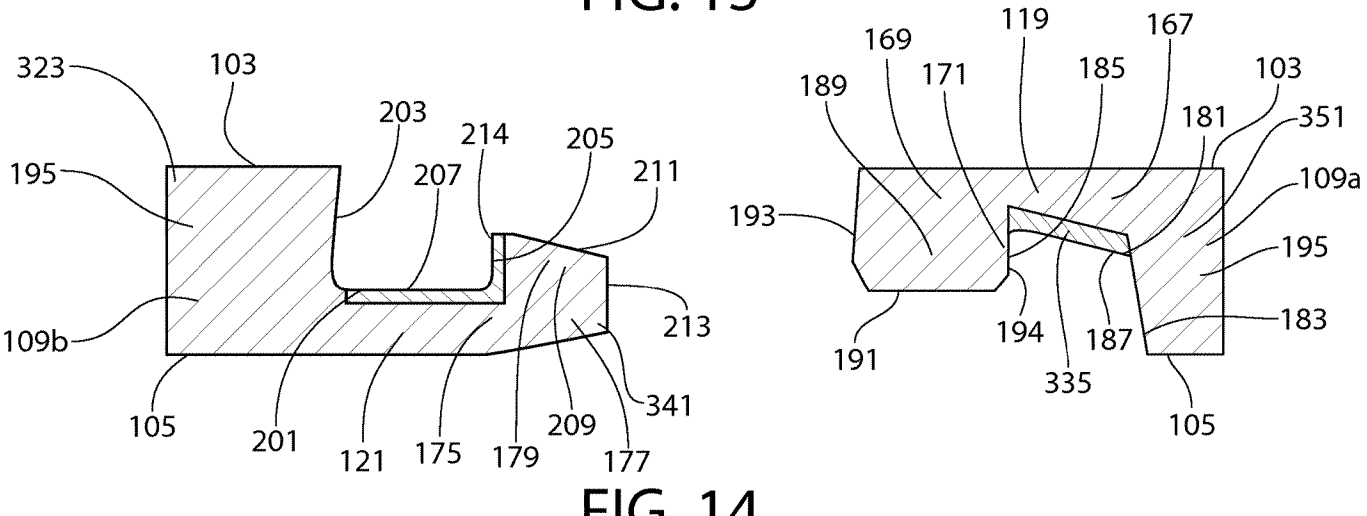
FIG. 14 shows a sectional view of the short edges of two adjacent floor panels according to a thirteenth embodiment.

FIG. 14 shows two short edges 109*a*, 109*b* of two adjacent floor panels 351, 353. The locking edge profile 119 of the first short edge 109*a* has a locking edge portion 167, which includes both horizontal locking features 169 and vertical locking features 171. Similarly, the locking edge profile 121 of the second short edge 109*b* has a locking edge portion 175, which includes both horizontal locking features 177 and vertical locking features 179.

The horizontal locking features 169 and the vertical locking features 171 of the locking edge portion 167 are incorporated into a locking channel 181 which is formed from an first channel sidewall 183, a second channel sidewall 185, and a channel floor 187. The horizontal locking features 169 and the vertical locking features 141 are also incorporated into a locking ridge 189 which is formed from a first ridge sidewall 194, a ridge top surface 191, and a second ridge sidewall 193. The base layer 104 of the floor panel 351 is formed out of a first material having a first hardness. The channel floor 187 includes a secondary material layer 355 which is formed out of a second material having a second hardness, with the second hardness being lower than the first hardness.

The horizontal locking features 177 and the vertical locking features 179 of the locking edge portion 175 are incorporated into a locking channel 201 formed from an first channel sidewall 203, a second channel sidewall 205, and a channel floor 207. The horizontal locking features 177 and the vertical locking features 179 are also incorporated into a locking ridge 209 which is formed from a first ridge sidewall 214, a ridge top surface 211, and a second ridge sidewall 213. The base layer 104 of the floor panel 353 is formed out of the first material. The second channel sidewall 205 and the channel floor 207 each include respective secondary material layers 357, 359 which are formed out of the second material.

The secondary material layers 355, 357, 359 facilitate interlocking of adjacent short edges 109*a*, 109*b* because the lower hardness of the secondary material layers 355, 357, 359, as compared to the respective base layers 195 of the adjacent floor panels 351, 353, provides an area of increased resiliency in the locking edge portions 167, 175 that is not otherwise present. These areas of increased resiliency may be compressed during the process of engagement, thereby facilitating adjacent floor panels entering into locking engagement. The areas of increased resiliency should serve to decrease noise produced by the floor installation as it ages.

Figure 15:
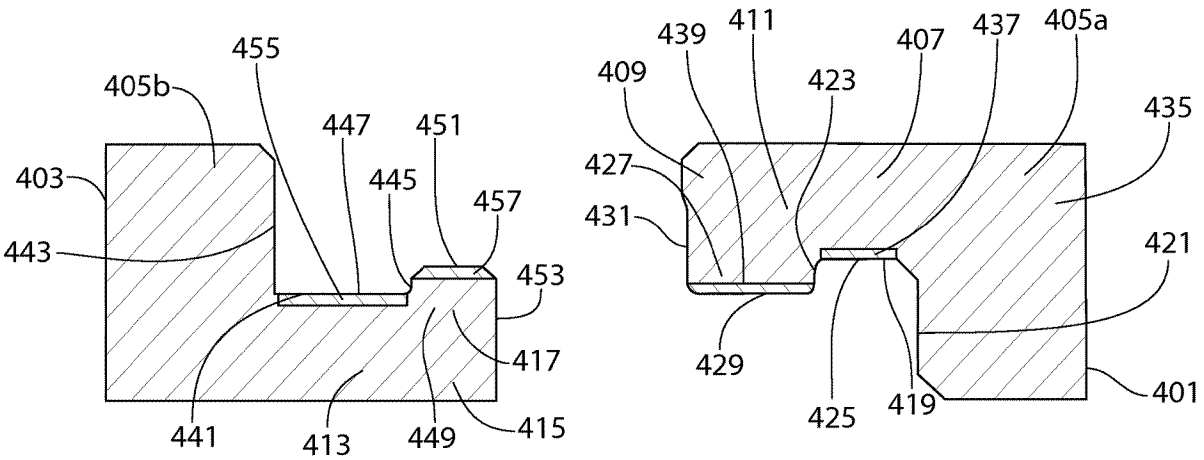
FIG. 15 shows a sectional view of the short edges of two adjacent floor panels according to a fourteenth embodiment.

FIG. 15 shows two short edges 405*a*, 405*b* of two adjacent floor panels 401, 403. The two long edges, which are not depicted, may have any desired configuration, one example of which is the configuration shown is FIG. 1B. The locking edge profile 407 of the first short edge 405*a* has a locking edge portion 409, which includes only horizontal locking features 411. Similarly, the locking edge profile 413 of the second short edge 405*b* has a locking edge portion 415, which includes only horizontal locking features 417.

The horizontal locking features 411 of the locking edge portion 409 are incorporated into a channel 419 which is formed from an first channel sidewall 421, a second channel sidewall 423, and a channel floor 425. The horizontal locking features 411 is also incorporated into a ridge 427 which is formed from the second channel sidewall 423, a ridge top surface 429, and a second ridge sidewall 431. The base layer 435 of the floor panel 401 is formed out of a first material having a first hardness. The channel floor 425 and the ridge top surface 429 both respectively include secondary material layers 437, 439 which are formed out of a second material having a second hardness, with the second hardness being lower than the first hardness.

The horizontal locking features 417 of the locking edge portion 415 are incorporated into a channel 441 formed from an first channel sidewall 443, a second channel sidewall 445, and a channel floor 447. The horizontal locking features 417 are also incorporated into a ridge 449 which is formed from the second channel sidewall 445, a ridge top surface 451, and a second ridge sidewall 453. The base layer 435 of the floor panel 403 is formed out of the first material. The channel floor 447 and the ridge top surface 451 each respectively include secondary material layers 455, 457 which are formed out of the second material.

The secondary material layers 437, 439, 455, 457, having a lower hardness as compared to the respective base layers 435 of the adjacent floor panels 401, 403, should serve to aid in decreasing noise from the floor as it ages.

Figure 16:
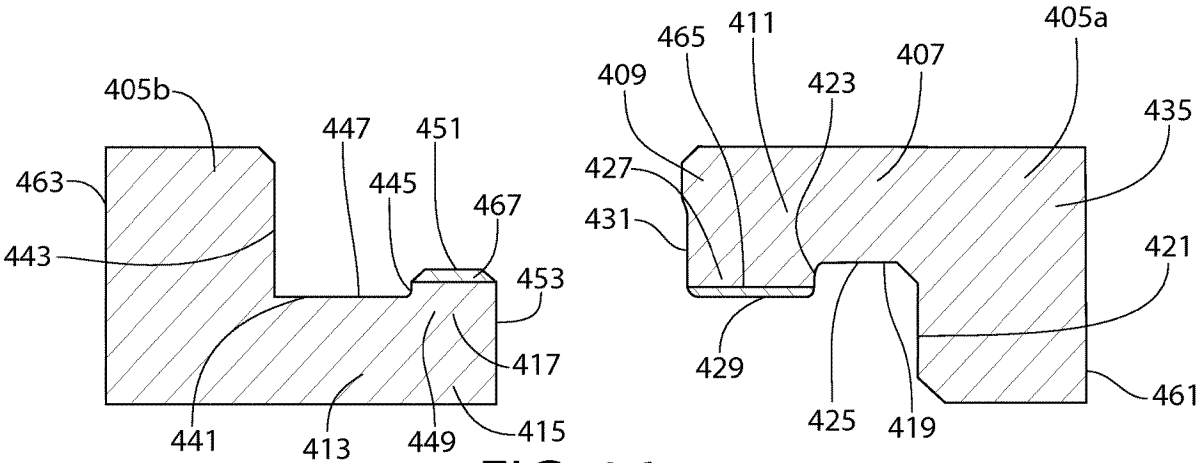
FIG. 16 shows a sectional view of the short edges of two adjacent floor panels according to a fifteenth embodiment.
Figure 17:
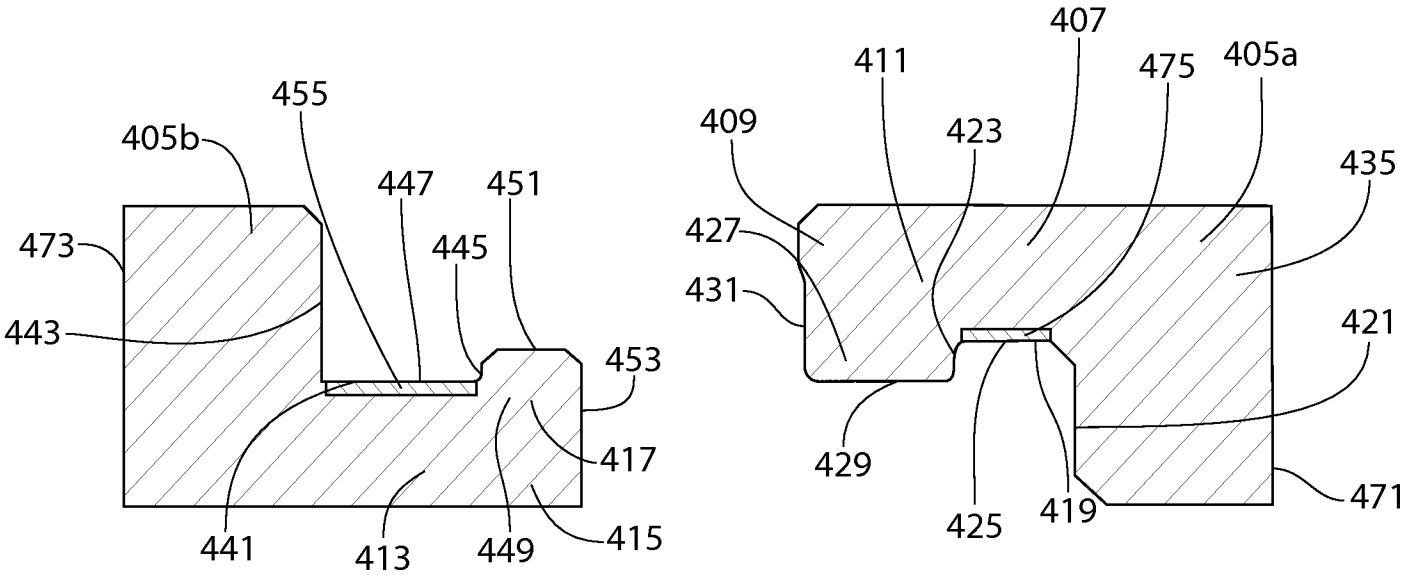
FIG. 17 shows a sectional view of the short edges of two adjacent floor panels according to a sixteenth embodiment.

The floor panels in FIGS. 16 and 17 share the same essential structural features of the locking profiles as the floor panels depicted in FIG. 15. Therefore, in the ensuing description of FIGS. 4-14, like reference numerals are used for like structural features of the locking profile. It should be noted, however, that unless otherwise recited in the claims, the structural features of any of the embodiments described and depicted herein are not to be limiting of the invention.

FIG. 16 shows two short edges 405*a*, 405*b* of two adjacent floor panels 461, 463. The two long edges, which are not depicted, may have any desired configuration, one example of which is the configuration shown is FIG. 1B. The locking edge profile 407 of the first short edge 405*a* has a locking edge portion 409, which includes only horizontal locking features 411. Similarly, the locking edge profile 413 of the second short edge 405*b* has a locking edge portion 415, which includes only horizontal locking features 417.

The horizontal locking features 411 of the locking edge portion 167 are incorporated into a channel 419 which is formed from an first channel sidewall 421, a second channel sidewall 423, and a channel floor 425. The horizontal locking features 411 is also incorporated into a ridge 427 which is formed from the second channel sidewall 423, a ridge top surface 429, and a second ridge sidewall 431. The base layer 435 of the floor panel 461 is formed out of a first material having a first hardness. The ridge top surface 429 includes a secondary material layer 465 which is formed out of a second material having a second hardness, with the second hardness being lower than the first hardness.

The horizontal locking features 417 of the locking edge portion 415 are incorporated into a channel 441 formed from an first channel sidewall 443, a second channel sidewall 445, and a channel floor 447. The horizontal locking features 417 are also incorporated into a ridge 449 which is formed from the second channel sidewall 445, a ridge top surface 451, and a second ridge sidewall 453. The base layer 435 of the floor panel 463 is formed out of the first material. The ridge top surface 451 includes a secondary material layer 467 which is formed out of the second material.

The secondary material layers 465, 467, having a lower hardness as compared to the respective base layers 435 of the adjacent floor panels 461, 463, should serve to decrease noise from the floor as it ages.

FIG. 17 shows two short edges 405*a*, 405*b* of two adjacent floor panels 471, 473. The two long edges, which are not depicted, may have any desired configuration, one example of which is the configuration shown is FIG. 1B. The locking edge profile 407 of the first short edge 405*a* has a locking edge portion 409, which includes only horizontal locking features 411. Similarly, the locking edge profile 413 of the second short edge 405*b* has a locking edge portion 415, which includes only horizontal locking features 417.

The horizontal locking features 411 of the locking edge portion 167 are incorporated into a channel 419 which is formed from an first channel sidewall 421, a second channel sidewall 423, and a channel floor 425. The horizontal locking features 411 is also incorporated into a ridge 427 which is formed from the second channel sidewall 423, a ridge top surface 429, and a second ridge sidewall 431. The base layer 435 of the floor panel 471 is formed out of a first material having a first hardness. The channel floor 425 includes a secondary material layer 475 which is formed out of a second material having a second hardness, with the second hardness being lower than the first hardness.

The horizontal locking features 417 of the locking edge portion 415 are incorporated into a channel 441 formed from an first channel sidewall 443, a second channel sidewall 445, and a channel floor 447. The horizontal locking features 417 are also incorporated into a ridge 449 which is formed from the second channel sidewall 445, a ridge top surface 451, and a second ridge sidewall 453. The base layer 435 of the floor panel 473 is formed out of the first material. The channel floor 447 includes a secondary material layer 477 which is formed out of the second material.

The secondary material layers 475, 477, having a lower hardness as compared to the respective base layers 435 of the adjacent floor panels 471, 473, should serve to decrease noise from the floor as it ages.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. A floating floor system comprising:

a plurality of floor panels, each of the floor panels comprising:

a base layer formed from a first material having a first hardness;

a body comprising a top surface and a bottom surface, the body formed from the base layer;

a first locking edge portion formed from the base layer and extending from a first side of the body, the first locking edge portion comprising a locking channel defined by a channel floor, a first channel sidewall extending upward from the channel floor toward the top surface, and a second channel sidewall extending upward from the channel floor toward the top surface;

a second locking edge portion formed from the base layer and extending from a second side of the body opposite the first side, the second locking edge portion comprising a locking ridge protruding downward away from the top surface, the ridge defined by a first ridge sidewall, a second ridge sidewall, and a ridge top surface;

wherein at least one of the first channel sidewall, the second channel sidewall, the first ridge sidewall, and the second ridge sidewall comprises a portion formed from a second material having a second hardness that is less than the first hardness;

wherein the plurality of floor panels are arranged in a mechanically interlocked arrangement in which the locking ridge of one floor panel is pressed into and nested within the locking channel of an adjacent floor panel such that the portion formed from the second material is compressed, thereby achieving an interference fit between the first and second channel sidewalls and the first and second ridge sidewalk;

wherein the locking channel comprises an upper channel section defined by upper portions of the first and second channel sidewalls and a lower channel section defined by lower portions of the first and second channel sidewalls, the upper channel section comprising a first channel width and the lower channel section comprising a second channel width, the first channel width being less than the second channel width;

wherein the locking ridge comprises a base section defined by upper portions of the first and second ridge sidewalls and a distal section defined by lower portions of the first and second ridge sidewalls, the base section comprising a first ridge width and the distal section comprising a second ridge width, the first ridge width being less than the second ridge width; and wherein at least one of the upper portion of the first channel sidewall, the upper portion of the second channel sidewall, the upper portion of the first ridge sidewall, and the upper portion of the second ridge sidewall is formed from the second material.

2. The floating floor system according to claim 1, wherein each of the upper portions of the first and second channel sidewalk are formed from the second material.

3. The floating floor system according to claim 1, wherein each of the upper portions of the first and second ridge sidewalls are formed from the second material.

4. The floating floor system according to claim 1, wherein the second ridge width is greater than the first channel width.

5. The floating floor system according to claim 4, wherein the at least one of the upper portion of the first channel sidewall, the upper portion of the second channel sidewall, the upper portion of the first ridge sidewall, and the upper portion of the second ridge sidewall that is formed from the second material compresses upon the distal section of the locking ridge passing through the upper section of the locking channel to allow the distal section of the locking ridge to enter and nest in the lower section of the channel.

6. The floating floor system according to claim 1, wherein the second material is an elastomeric material.

7. The floating floor system according to claim 1, wherein the first material is selected from a high density fiberboard, a medium density fiberboard, wood, or a combination thereof.

8. The floating floor system according to claim 1, wherein the surface portion formed of the second material which is compressed remains under continuous compression when the plurality of floor panels are in the mechanically interlocked arrangement.

9. The floating floor system according to claim 1, wherein the compression of the surface portion formed of the second material generates a counter force having a horizontal vector component that prevents vertical movement of the ridges within the channels when the plurality of floor panels are in the mechanically interlocked arrangement.

10. A floating floor system comprising:

a plurality of floor panels, each of the floor panels comprising:

a base layer formed from a first material having a first hardness;

a body comprising a top surface and a bottom surface, the body formed from the base layer;

a first locking edge portion formed from the base layer and extending from a first side of the body, the first locking edge portion comprising a locking channel defined by a channel floor, a first channel sidewall extending upward from the channel floor toward the top surface, and a second channel sidewall extending upward from the channel floor toward the top surface;

a second locking edge portion formed from the base layer and extending from a second side of the body opposite the first side, the second locking edge portion comprising a locking ridge protruding downward away from the top surface, the ridge defined by a first ridge sidewall, a second ridge sidewall, and a ridge top surface;

wherein at least one of the first channel sidewall, the second channel sidewall, the first ridge sidewall, and the second ridge sidewall comprises a portion formed from a second material having a second hardness that is less than the first hardness;

wherein the plurality of floor panels are arranged in a mechanically interlocked arrangement in which the locking ridge of one floor panel is pressed into and nested within the locking channel of an adjacent floor panel such that the portion formed from the second material is compressed, thereby achieving an interference fit between the first and second channel sidewalk and the first and second ridge sidewalk;

wherein the locking channel extends along a channel axis that lies within a channel reference plane, the channel reference plane being substantially perpendicular to the top surface;

the first channel sidewall converges with top surface of the main body to form a first upper peripheral edge of the floor panel;

the second channel sidewall located opposite the first channel sidewall, the second channel sidewall extending upward from the channel floor at an oblique angle with respect to the channel reference plane;

wherein the second ridge sidewall converges with the upper surface of the second locking edge portion to form a second upper peripheral edge of the floor panel, the second ridge sidewall being located opposite the first ridge sidewall;

wherein one of the second channel sidewall and the first ridge sidewall is formed from the second material and the other one of the second channel sidewall and the first ridge sidewall is formed from the first material; and wherein the second channel sidewall of a floor panel mates with the first ridge sidewall of an adjacent floor panel to compress the second material that forms the second channel sidewall or the first ridge sidewall.

11. The floating floor system according to claim 10 wherein the first and second upper peripheral edges are free of the second material.

12. A floating floor system comprising:

a plurality of floor panels, each of the floor panels comprising:

a base layer formed from a first material having a first hardness;

a body comprising a top surface and a bottom surface, the body formed from the base layer;

a first locking edge portion formed from the base layer and extending from a first side of the body, the first locking edge portion comprising a locking channel defined by a channel floor, a first channel sidewall extending upward from the channel floor toward the top surface, and a second channel sidewall extending upward from the channel floor toward the top surface; and a second locking edge portion formed from the base layer and extending from a second side of the body opposite the first side, the second locking edge portion comprising a locking ridge protruding downward away from the top surface, the ridge defined by a first ridge sidewall, a second ridge sidewall, and a ridge too surface;

wherein at least one of the first channel sidewall, the second channel sidewall, the first ridge sidewall, and the second ridge sidewall comprises a surface portion formed from a second material having a second hardness that is less than the first hardness; and wherein the plurality of floor panels are arranged in a mechanically interlocked arrangement in which the locking ridge of one floor panel is pressed into and nested within the locking channel of an adjacent floor panel such that the surface portion formed from the second material is compressed, thereby achieving an interference fit between the first and second channel sidewalls and the first and second ridge sidewalls; and wherein for each of the floor panels:

the locking channel of the first locking edge portion comprises an upper channel section and a lower channel section, the lower channel section located between the upper channel section and the channel floor, the upper channel section comprising a first channel width, and the lower channel section comprising a second channel width, the second channel width being greater than the first channel width; and the locking ridge of the second locking edge portion comprises a base ridge portion and a distal ridge portion, the distal ridge portion located between the ridge top surface and the base ridge portion, the base ridge portion comprising a first ridge width, and the distal ridge portion comprising a second ridge width, the second ridge width being greater than the first ridge width.

13. The floating floor system according to claim 12 wherein for each of the floor panels, the second ridge width is greater than the first channel width.

14. The floating floor system according to claim 12, wherein for each of the floor panels, the second material is in the form of a layer comprising:

a first side surface and a second side surface opposite the first side surface, the first side surface comprising the surface portion;

a first thickness, measured from the first side surface to the second side surface, in a normal state when the plurality of floor panels are not in the mechanically interlocked arrangement; and a second thickness, measured from the first side surface to the second side surface, in a compressed state when the plurality of floor panels are arranged in the mechanically interlocked arrangement; and wherein the first thickness is greater than the second thickness.

15. A floating floor system comprising:

a plurality of floor panels, each of the floor panels comprising:

a base layer formed from a first material having a first hardness;

a body comprising a top surface and a bottom surface, the body formed from the base layer;

a first locking edge portion formed from the base layer and extending from a first side of the body, the first locking edge portion having a first locking profile comprising a locking channel defined by a channel floor, a first channel sidewall extending upward from the channel floor toward the top surface, and a second channel sidewall extending upward from the channel floor toward the top surface, the channel comprising an upper channel section defined by upper portions of the first and second channel sidewalls and a lower channel section defined by lower portions of the first and second channel sidewalls;

a second locking edge portion formed from the base layer and extending from a second side of the main body opposite the first side, the second locking edge portion having a second locking profile comprising a locking ridge protruding downward away from the top surface, the locking ridge defined by a first ridge sidewall, a second ridge sidewall, and a ridge top surface, the ridge comprising a base section defined by upper portions of the first and second ridge sidewalls and a distal section defined by lower portions of the first and second ridge sidewalls;

wherein a surface portion of at least one of the upper portion of the first channel sidewall, the upper portion of the second channel sidewall, the lower portion of the first ridge sidewall, and the lower portion of the second ridge sidewall is formed from a second material having a second hardness that is less than the first hardness; and wherein the first and second locking profiles are configured so that upon the locking ridge of one floor panel being inserted into the locking channel of an adjacent floor panel, the surface portion formed from the second material is compressed from a normal state to a compressed state as the distal section of the locking ridge passes through the upper channel section;

wherein the upper channel section comprises a first channel width, and the lower channel section comprises a second channel width, the second channel width being greater than the first channel width; and wherein the base ridge portion comprises a first ridge width, and the distal ridge portion comprises a second ridge width, the second ridge width being greater than the first ridge width.

16. The floating floor system according to claim 15, wherein the second ridge width is greater than the first channel width.

17. The floating floor system according to claim 15, wherein for each of the floor panels, the second material is in the form of a layer comprising:

a first side surface and a second side surface opposite the first side surface, the first side surface comprising the surface portion;

a first thickness, measured from the first side surface to the second side surface, in the normal state;

a second thickness, measured from the first side surface to the second side surface, in the compressed state; and wherein the first thickness is greater than the second thickness.

* * * * *